US011191302B1

(12) United States Patent
Rahib et al.

(10) Patent No.: US 11,191,302 B1
(45) Date of Patent: Dec. 7, 2021

(54) METHOD AND DEVICE FOR PACKAGING CIGARS, CIGAR TOBACCO LEAVES AND MIXED CIGAR TOBACCO LEAF

(71) Applicant: Sandy Rahib, San Diego, CA (US)

(72) Inventors: Sandy Rahib, San Diego, CA (US); Akrum Al Rahib, Los Angeles, CA (US)

( * ) Notice: Subject to any disclaimer, the term of this patent is extended or adjusted under 35 U.S.C. 154(b) by 157 days.

(21) Appl. No.: 16/736,686

(22) Filed: Jan. 7, 2020

Related U.S. Application Data

(60) Provisional application No. 62/790,940, filed on Jan. 10, 2019.

(51) Int. Cl.

| | |
|---|---|
| ***A24F 15/12*** | (2006.01) |
| ***B65D 85/10*** | (2006.01) |
| ***B65D 85/12*** | (2006.01) |
| ***A24F 23/02*** | (2006.01) |

(52) U.S. Cl.
CPC ..... *A24F 15/12* (2013.01); *B65D 85/1018* (2013.01); *B65D 85/12* (2013.01); *A24F 23/02* (2013.01); *B65D 2575/586* (2013.01)

(58) Field of Classification Search
CPC .... A24B 1/04; A24C 1/00; A24C 1/26; A24C 3/00; A24D 1/02; A24F 1/10; A24F 15/12; A24F 23/02; B65D 85/10; B65D 85/1018; B65D 85/12; B65D 2575/586
USPC ..... 383/37
See application file for complete search history.

(56) References Cited

U.S. PATENT DOCUMENTS

| | | | | |
|---|---|---|---|---|
| 3,738,566 | A * | 6/1973 | Foster | B65D 33/1691 383/37 |
| 7,604,008 | B2 * | 10/2009 | Gomez | A24B 15/282 131/365 |
| 8,069,861 | B2 * | 12/2011 | Sinclair, Jr. | B65D 75/38 131/330 |
| 8,469,038 | B2 * | 6/2013 | Sinclair, Jr. | A24D 1/02 131/369 |
| 9,032,969 | B1 * | 5/2015 | Sinclair, Jr. | A24D 1/02 131/280 |
| 9,433,240 | B2 * | 9/2016 | Sinclair, Jr. | A24C 5/40 |
| 10,111,460 | B2 * | 10/2018 | Tully | A24F 17/00 |
| 10,806,173 | B2 * | 10/2020 | Tully | A24C 5/44 |
| 2014/0360519 | A1 * | 12/2014 | George | A24C 5/40 131/365 |

(Continued)

FOREIGN PATENT DOCUMENTS

CN 104413545 A * 3/2015 ..... A24D 1/00

*Primary Examiner* — Bryon P Gehman
(74) *Attorney, Agent, or Firm* — Sci-Law Strategies PC

(57) ABSTRACT

The present invention is directed to a pouch pack made up of a plurality of pouches where each pouch is a re-sealable container for preserving single or multiple cigars or single or multiple cigar tobacco leaves. A perforation allows the pouch pack to be separated into the individual pouches without damage to the pouches. A vent/seal allows the atmosphere in the pouch to be controlled. A form encases the cigar tobacco leaf in the pouch pack while allowing the cigar tobacco leaf to equilibrate with the atmosphere in the pouch which is controlled by one or more of a humectant, a vent/seal and a sensor to control the humidity in the pouch. In an embodiment of the invention, the form is one or more wrapped cigar tobacco leaves. A mold protects a cigar or a cigar tobacco leaf from damage by an external force exerted on the pouch or pouch pack.

20 Claims, 8 Drawing Sheets

(56) References Cited

U.S. PATENT DOCUMENTS

2015/0083142 A1* 3/2015 Sinclair, Jr. ..... A24D 1/00
131/108

* cited by examiner

METHOD AND DEVICE FOR PACKAGING CIGARS, CIGAR TOBACCO LEAVES AND MIXED CIGAR TOBACCO LEAF

FIELD OF THE INVENTION

The present invention relates to methods and devices for storing, shipping, packaging and preserving cigars, cigar tobacco leaves and other mixed cigar tobacco leaf products.

BACKGROUND OF THE INVENTION

Cigar tobacco leaves after harvesting from *Nicotiana tabacum, N. rustica* or similar species are cured using a process to reduce sugar and water content without causing the leaves to rot. The process can involve heating in an enclosure (i.e., out of direct sunlight) for between 20 to 50 days. The cigar tobacco leaf is then fermented, where conditions (e.g., temperature and humidity) are controlled. Fermenting can enhance flavor, aroma, and burning characteristics. A cigar tobacco leaf can be aged for decades if kept at approximately 21° C. and 70 percent relative humidity.

Cigar tobacco contains nicotine and harmala alkaloids. Nicotine is an anti-herbivory alkaloid. It is a potent parasympathomimetic stimulant. Nicotine acts as an agonist at most nicotinic acetylcholine receptors. Nicotine acts as an antagonist at nicotinic acetylcholine receptors $\alpha 9$ and nicotinic acetylcholine receptors $\alpha 10$ subunits. Harmala alkaloids include harmine, harmaline, and harmalol, which are naturally occurring beta-carboline alkaloids that function as monoamine oxidase inhibitors and that have affects in humans that include anti-depression, analgesia and reducing social phobias.

A wrapper is the outer leaf of a cigar. The integrity of the wrapper is important. A good quality wrapper can amount to 70 percent of the value of the cigar. A good wrapper is chosen based on aroma, flavor and burning qualities. A cigar wrapper is examined for appearance, texture and aroma.

A 'blunt' or a 'dutch' in contrast to a 'spliff' are marijuana rolled with the wrapper. A spliff is a West Indian or Jamaican word for a blend of tobacco and *cannabis*. The names 'blunt' and 'dutch' come from specific brands (e.g., Philies Blunt and Dutch Masters).

The word 'joint' originates from the French 'rejoint' meaning joined. Joints contain marijuana and are rolled with lighter, partially translucent papers. Rolling papers to encase marijuana can be made out of composites including corn, plant cellulose, hemp, rice, flax seed and wood fibers or wood pulp.

A 'cone' is a partially constructed joint that is open at a trumpet end to allow a user to fill with marijuana and then twist close the opening at the trumpet end.

One advantage of a 'blunt, or a 'dutch' is that they reduce the smell of marijuana. The wrapper aroma and scent, if sufficiently strong, can mask the smell of the oxidizing marijuana.

Further, researchers have found that the tobacco in the blunt or dutch provides an initial nicotine effect after which the user experiences the *cannabis* effect. When you mix marijuana with tobacco, the THC and the nicotine work synergistically. Further, with short term tobacco use, the receptors in the brain that bind cannabinoids can actually become sensitized. However, over long term use the cannabinoid receptors can become de-sensitized. Another difference between the blunt, the joint and the spliff is the amount of marijuana that is contained in each. Generally the blunt or dutch can hold more marijuana.

SUMMARY OF THE INVENTION

In an embodiment of the present invention, a re-sealable pouch allows a cigar tobacco leaf to be packaged, distributed and sold separately without exposure of the cigar tobacco leaf to the atmosphere. In an embodiment of the present invention, a transport form and/or mold allows a rolled cigar tobacco leaf to be packaged, transported, distributed and sold while retaining its rolled form. In an embodiment of the present invention, a re-sealable pouch allows a rolled cigar tobacco leaf in a transport form and/or mold to be packaged, distributed and sold separately without exposure of the cigar tobacco leaf to the atmosphere. In an embodiment of the present invention, a transport form and/or mold allows a rolled cigar tobacco leaf to be inserted into a re-sealable pouch and packaged, transported, distributed and sold while retaining its rolled form and without exposure of the cigar tobacco leaf to the atmosphere. In an embodiment of the present invention, a transport form and/or mold allows a cigar tobacco leaf cone to be packaged, transported, distributed and sold while retaining its cone form. In an embodiment of the present invention, a re-sealable pouch allows a cigar tobacco leaf cone in a transport form and/or mold to be packaged, distributed and sold separately without exposure of the cigar tobacco leaf cone to the atmosphere. In an embodiment of the present invention, a transport form and/or mold allows a cigar tobacco leaf cone to be inserted into a re-sealable pouch and packaged, transported, distributed and sold while retaining its cone form and without exposure of the cigar tobacco leaf cone to the atmosphere. In an embodiment of the present invention, a re-sealable pouch is adapted to self-contain one or more cigar tobacco leaves, where each cigar tobacco leaf is separated by a humectant within the re-sealable pouch, where the re-sealable pouch is packaged to allow the distribution and eventual separate sale or use of the one or more cigar tobacco leaves with m minimal exposure of the remaining cigar tobacco leaves to the atmosphere.

BRIEF DESCRIPTION OF THE DRAWINGS

This invention is described with respect to specific embodiments thereof. Additional aspects can be appreciated from the Figures in which.

DETAILED DESCRIPTION OF THE INVENTION

Definitions

Figure 1:
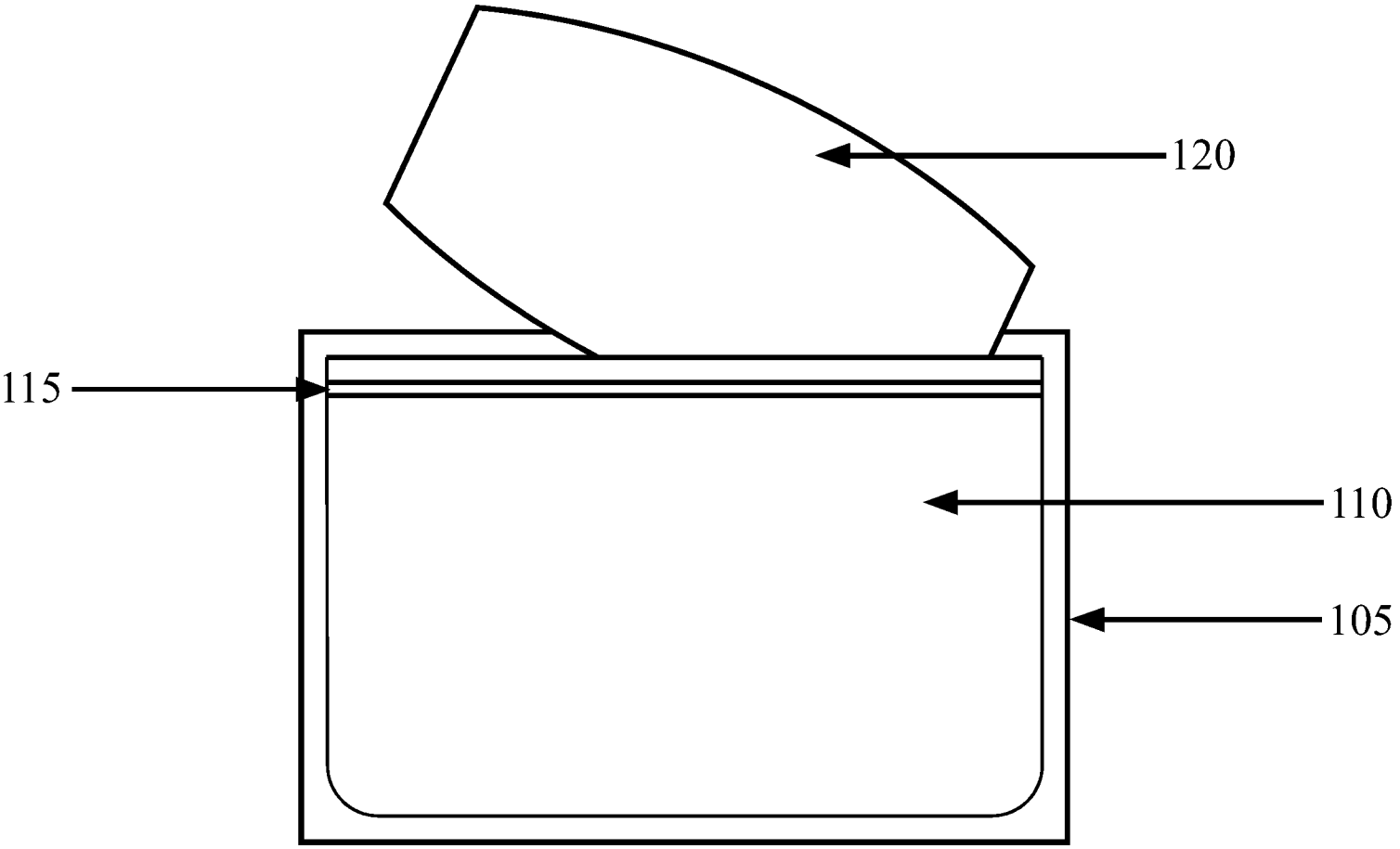
FIG. 1 is a schematic diagram of a re-sealable pouch which allows a cigar tobacco leaf to be self-contained and packaged, according to an embodiment of the invention.

The transitional term "comprising" is synonymous with "including," "containing," or "characterized by," is inclusive or open-ended and does not exclude additional, unrecited elements or method steps.

The transitional phrase "consisting of" excludes any element, step, or ingredient not specified in the claim, but does not exclude additional components or steps that are unrelated to the invention such as impurities ordinarily associated with a composition.

The transitional phrase "consisting essentially of" limits the scope of a claim to the specified materials or steps and those that do not materially affect the basic and novel characteristic(s) of the claimed invention.

A 'metal' comprises one or more elements consisting of lithium, beryllium, boron, carbon, nitrogen, oxygen, sodium, magnesium, aluminum, silicon, phosphorous, sulphur, potassium, calcium, scandium, titanium, vanadium, chromium, manganese, iron, cobalt, nickel, copper, zinc, gallium, germanium, arsenic, selenium, rubidium, strontium, yttrium, zirconium, niobium, molybdenum, technetium, ruthenium, rhodium, palladium, silver, cadmium, indium, tin, antimony, tellurium, cesium, barium, lanthanum, cerium, praseodymium, neodymium, promethium, samarium, europium, gadolinium, terbium, dysprosium, holmium, erbium, thulium, ytterbium, lutetium, hafnium, tantalum, tungsten, rhenium, osmium, iridium, platinum, gold, mercury, thallium, lead, bismuth, polonium, francium and radium.

A 'plastic' comprises one or more of polystyrene, high impact polystyrene, polypropylene, polycarbonate, low density polyethylene, high density polyethylene, polypropylene, acrylonitrile butadiene styrene, polyphenyl ether alloyed with high impact polystyrene, expanded polystyrene, polyphenylene ether and polystyrene impregnated with pentane, a blend of polyphenylene ether and polystyrene impregnated with pentane or polyethylene and polypropylene.

A 'polymer' comprises a material synthesized from one or more reagents selected from the group comprising of styrene, propylene, carbonate, ethylene, acrylonitrile, butadiene, vinyl chloride, vinyl fluoride, ethylene terephthalate, terephthalate, dimethyl terephthalate, bis-beta-terephthalate, naphthalene dicarboxylic acid, 4-hydroxybenzoic acid, 6-hyderoxynaphthalene-2-carboxylic acid, mono ethylene glycol (1,2 ethanediol), cyclohexylene-dimethanol, 1,4-butanediol, 1,3-butanediol, polyester, cyclohexane dimethanol, terephthalic acid, isophthalic acid, methylamine, ethylamine, ethanolamine, dimethylamine, hexamthylamine diamine (hexane-1,6-diamine), pentamethylene diamine, methylethanolamine, trimethylamine, aziridine, piperidine, N-methylpiperideine, anhydrous formaldehyde, phenol, bisphenol A, cyclohexanone, trioxane, dioxolane, ethylene oxide, adipoyl chloride, adipic, adipic acid (hexanedioic acid), sebacic acid, glycolic acid, lactide, caprolactone, aminocaproic acid and or a blend of two or more materials synthesized from the polymerization of these reagents.

A 'plastic foam' is a polymer or plastic in which a gaseous bubble is trapped including polyurethane, expanded polystyrene, phenolic foam, XPS foam and quantum foam.

A 'mold' refers, in the usual customary sense, to a structure that is adapted to surround a cigar tobacco leaf to protect the shape and integrity of the cigar tobacco leaf. A mold can be made from a metal, a plastic, a plastic foam, wood, paper, cardboard, recycled paper, paper amended with recycled paper, cardboard amended with recycled cardboard, recycled cardboard and the like. In an embodiment of the present invention, a transport form can include a humectant. In an embodiment of the present invention, a mold can include a humectant. In an embodiment of the present invention, a mold and a transport form can each include a humectant. In an embodiment of the invention, where the mold acts as a humectant, the mold can be made from a non-porous material and a porous humectant material, where the latter is associated with a surface thereof. In an embodiment of the present invention, the cigar tobacco leaf can be in gaseous communication with the humectant associated with the mold. A plastic mold partially surrounding a cigar tobacco leaf can have a region e.g., a strip adhered to a surface of the mold at a position such that the cigar tobacco leaf cannot come in physical contact with the humectant. During storage, shipment, distribution, retail display and user use of the pouch (e.g., user characteristic evacuation of atmosphere within the pouch) the cigar tobacco leaf is protected against physical damage by the mold. In an embodiment of the invention, the mold does not form an air tight seal around the cigar tobacco leaf and thereby when the mold and cigar tobacco leaf are inserted into a pouch, one or more of a humectant and the vent/seal can adjust the atmosphere in and around the cigar tobacco leaf contained in the mold in the pouch.

A 'form' refers, in the usual customary sense, to a structure that is adapted to hold from within to provide internal support a cigar tobacco leaf in a set shape. In an embodiment of the invention, the form is one or more wrapped cigar tobacco leaves. In an embodiment of the invention, the form is associated with a humectant. In alternative embodiments of the invention, a form can be made from a metal, a plastic, a plastic foam, wood, paper, cardboard, recycled paper, paper amended with recycled paper, cardboard amended with recycled cardboard, recycled cardboard and the like. In an embodiment of the present invention, a form can also include a humectant. In an embodiment of the invention, where the form acts as a humectant, the form can be made from a non-porous material and a porous humectant material, where the latter is associated with a surface of the form. In an embodiment of the present invention, the cigar tobacco leaf is in gaseous communication with the humectant associated with the form. A plastic form partially supporting a cigar tobacco leaf can have a region e.g., a strip adhered to a surface of the form at a position such that the cigar tobacco leaf cannot come in physical contact with the humectant.

A 'mold/form' refers to a structure that is adapted to (i) support from within to insure the integrity of a cigar tobacco leaf in a set shape from collapse and (ii) to surround the cigar tobacco leaf to insure the integrity thereof from impact caused by external forces. A mold/form can be made from a metal, a plastic, a plastic foam, wood, paper, cardboard, recycled paper, paper amended with recycled paper, cardboard amended with recycled cardboard, recycled cardboard and the like. In an embodiment of the invention, a cigar tobacco leaf can be (i) partially internally supported and/or (ii) partially externally surrounded by a 'mold/form'. A mold/form has characteristics of both a form and a mold, i.e., to (i) support and protect, and (ii) surround and protect a cigar tobacco leaf. In an embodiment of the invention, a mold/form is a contiguous object (including a contiguous metal contiguous plastic, contiguous wood or the like). In an embodiment of the present invention, a mold/form can also include a humectant. In an embodiment of the invention, where the mold/form acts as a humectant, the mold/form can be partially made from a non-porous material and a porous humectant material. In an embodiment of the present invention, a porous humectant material can be associated with a surface of the mold/form, such that the cigar tobacco leaf is in gaseous communication with the humectant associated with the mold/form. A plastic mold/form partially supporting and surrounding a cigar tobacco leaf can have a region e.g., a strip adhered to a surface thereof at a position such that the cigar tobacco leaf cannot come in physical contact with the humectant. During storage, shipment, distribution, retail display the cigar tobacco leaf is protected against physical damage by the mold/form.

A 'pouch' refers, in the usual customary sense, to a structure that is adapted to encase a cigar tobacco leaf in a protective atmosphere. A pouch can be re-sealable. The pouch can be used to store, ship, distribute, and display one or more cigar tobacco leaves, where the cigar tobacco leaf is protected against environmental damage. In an embodiment of the invention, the cigar tobacco leaves are held in a useful configuration within the pouch by a mold, a form or a mold/form. The pouch can include on the outside writing with directions for use of the cigar tobacco leaf.

A 'sensor' refers, in the usual customary sense, to a structure that is adapted to sense the amount of atmosphere in a pouch. The sensor can gauge one or more of the atmosphere volume and atmosphere pressure in the pouch. The sensor can be a complicated electronic device or a simple mechanical device. An electronic sensor can be adapted to determine the resonant frequency (maximum acoustic response) of the pouch. As the frequency increases, the detector is determining that the volume has become smaller and thereby the amount of atmosphere has decreased. The pouch's resonant frequency can be a function of its volume. A Helmholtz resonator can determine the volume of the pouch. A smaller volume is reflected in a larger frequency. A mechanical sensor can be based on the pressure applied required to open the vent, where the vent closes when the pressure applied is not sufficient to open a diaphragm.

A 'vent/seal' refers, in the usual customary sense, to a structure that is adapted to control the flow of atmosphere into and out of a pouch after the pouch is sealed in order to regulate the amount of atmosphere in the pouch. The vent/seal can include a sensor to gauge one or more of the atmosphere volume and atmosphere pressure in the pouch. The vent/seal can be a passive device which regulates the volume of atmosphere based on a user characteristic. In an embodiment of the invention, the user characteristic can be clapping the pouch. Each user will use a force based on their strength resulting in a user characteristic. In an embodiment of the invention, a sensor and vent/seal responds to pressure applied to the outside of the pouch by releasing atmosphere from the pouch until the amount of atmosphere in the pouch is reduced to an amount that can be controlled by the humectant. The pouch can include directions for use of the sensor and vent/seal. In an embodiment of the invention, the vent/seal can include a humectant. For example, a humectant can be associated with the vent/seal on the inside of the pouch to control the humidity of the pouch.

A 'pouch pack' can be a plurality of connected pouches. The pouch pack can include a perforation, scoring or the like to separate individual pouches. The pouch pack can include directions for use and ordering of the cigar tobacco leaves.

The phrase a 're-sealable opening' refers, in the usual customary sense, to a structure that allows a container, e.g., a pouch as described herein, to be opened and accessed and then closed and sealed such that the atmosphere is in homeostasis.

A 'humectant' refers, in the usual customary sense, to a structure that is adapted to control the humidity of an atmosphere in a pouch. In an embodiment of the invention, the structure is a layer. A cigar tobacco leaf can be inserted in a pouch together with a humectant. The humectant prevents the cigar tobacco leaf from one or more of drying out, becoming over hydrated (soggy leaf) and maintaining the proscribed shape of the cigar tobacco leaf. In an embodiment of the invention, the cigar tobacco leaves are held in a useful configuration within the pouch by a mold, a form or a mold/form together with a humectant. In an embodiment of the invention, the humectant maintains the shape or integrity of the cigar tobacco leaf relative to the mold, form or mold/form. In an embodiment of the invention, a humectant can be a chemical substance associated with a structure.

An 'additive' refers, in the usual customary sense, to a compound that is added to a cigar tobacco leaf that controls rotting of the cigar tobacco leaf. In an embodiment of the invention, the additive can have antifungal properties. The term 'fungal mold' is a fungal infection, not to be confused with a 'mold' as otherwise described herein. In another embodiment of the invention, the additive can have antibacterial properties. In an alternative embodiment of the invention, the additive can have antiseptic properties. In an embodiment of the invention, extracts from *Phyllanthus amarus, Euphorbia hirta, Euphorbia heterophylla* or *Acalypha fimbriata* can be used to inhibit the growth of rot fungi of the cigar tobacco leaf. In an embodiment of the invention, extracts of Euphorbiaceae can be used to inhibit *Chrysophyllum albidum*. In an embodiment of the invention, honey can be used to inhibit the growth of cigar tobacco leaf rot. Honey contains monosaccharides, fructose, and glucose. Honey has antimicrobial and antifungal properties. The antimicrobial activity is due to production of hydrogen peroxide by a bee-derived enzyme, glucose oxidase. Honey has antiseptic and antibacterial properties attributed to phytochemical components that further enhance its antimicrobial activity. Honey is active at least against *Candida anbacans, C. dubliniensis* and *C. glabrata.*

Susceptible material refers, in the usual customary sense, to matter that has come from a once-living plant and is composed of organic compounds. Susceptible material is capable of combustive oxidation. In an embodiment of the invention, a cigar tobacco leaf can be filled with susceptible matter.

In the following description, various aspects of the present invention will be described. However, it will be apparent to those skilled in the art that the present invention may be practiced with only some or all aspects of the present invention. In other instances, well-known features are omitted or simplified in order not to obscure the present invention. For purposes of explanation, specific numbers, materials, and configurations are set forth in order to provide a thorough understanding of the present invention.

Figure 4:
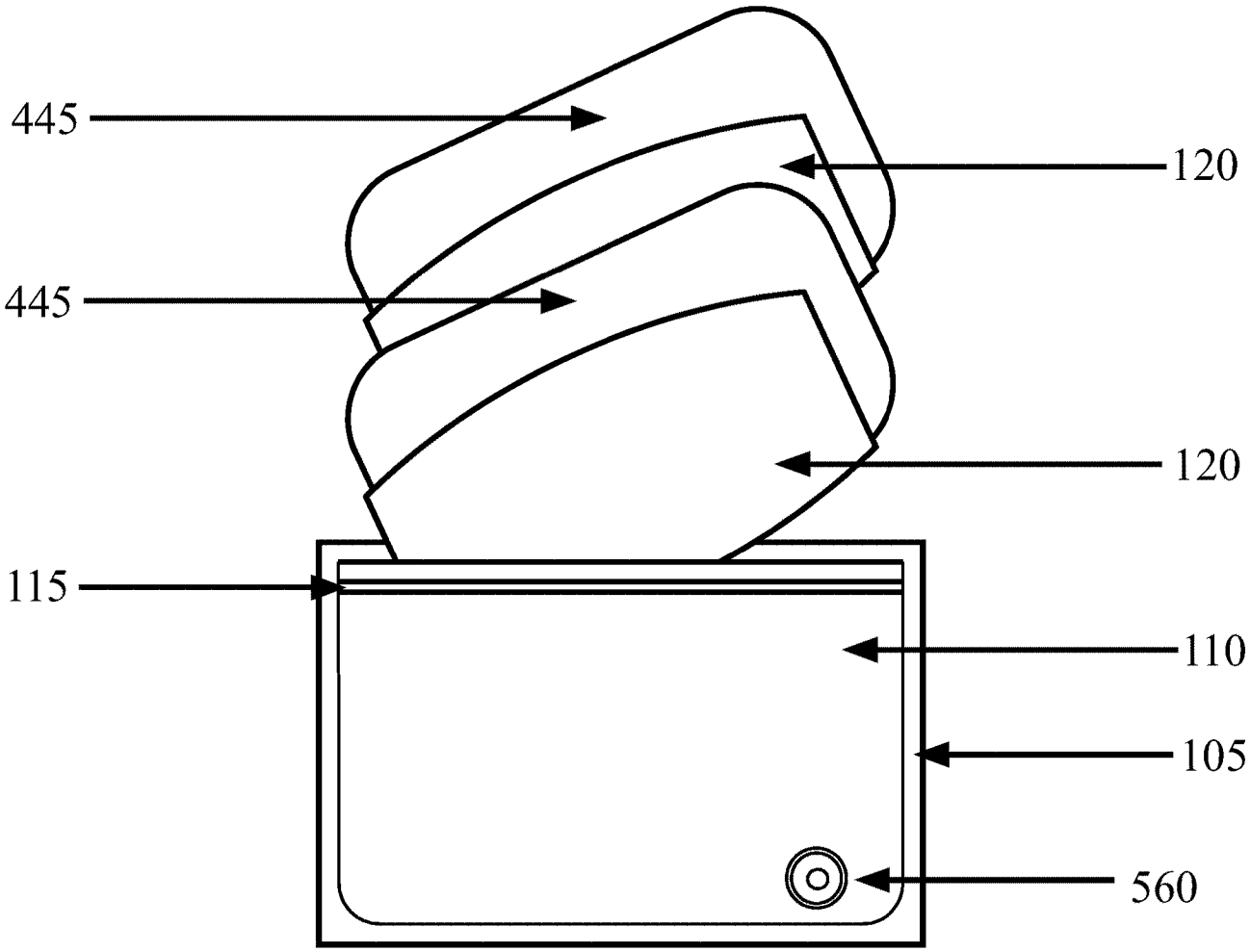
FIG. 4 is a schematic diagram of a re-sealable pouch which allows one or more cigar tobacco leaves to be self-contained, where each of the cigar leaves is separated by a humectant, according to an embodiment of the invention.

Once cured and fermented, a cigar tobacco leaf can be treated with an additive to inhibit rot. In an embodiment of the invention, a mixture of alcohol and/or honey can be applied to the cigar tobacco leaf to treat protect the cigar tobacco leaf from leaf rot. FIG. 1 shows a schematic diagram of a single pouch 105 with a re-sealable opening 115 which allows a treated cigar tobacco leaf 120 to be contained inside the pouch 110 and packaged. FIG. 4 is a schematic diagram of a single pouch 105 with a re-sealable opening 115 which allows two or more treated cigar tobacco leaves 120 to be inserted and separately removed, where each of the cigar leaves is separated by a humectant 445 to be contained inside the pouch 110, where the pouch has a vent/seal 560 to adjust the volume of atmosphere in the pouch 110, to insure that the humectant 445 remains efficient for preserving the packaged cigar tobacco leaves 120. In an embodiment of the invention, an additive can be applied to each cigar tobacco leaf to treat or protect the cigar tobacco leaf from degradation, e.g., leaf rot.

Figure 2A:
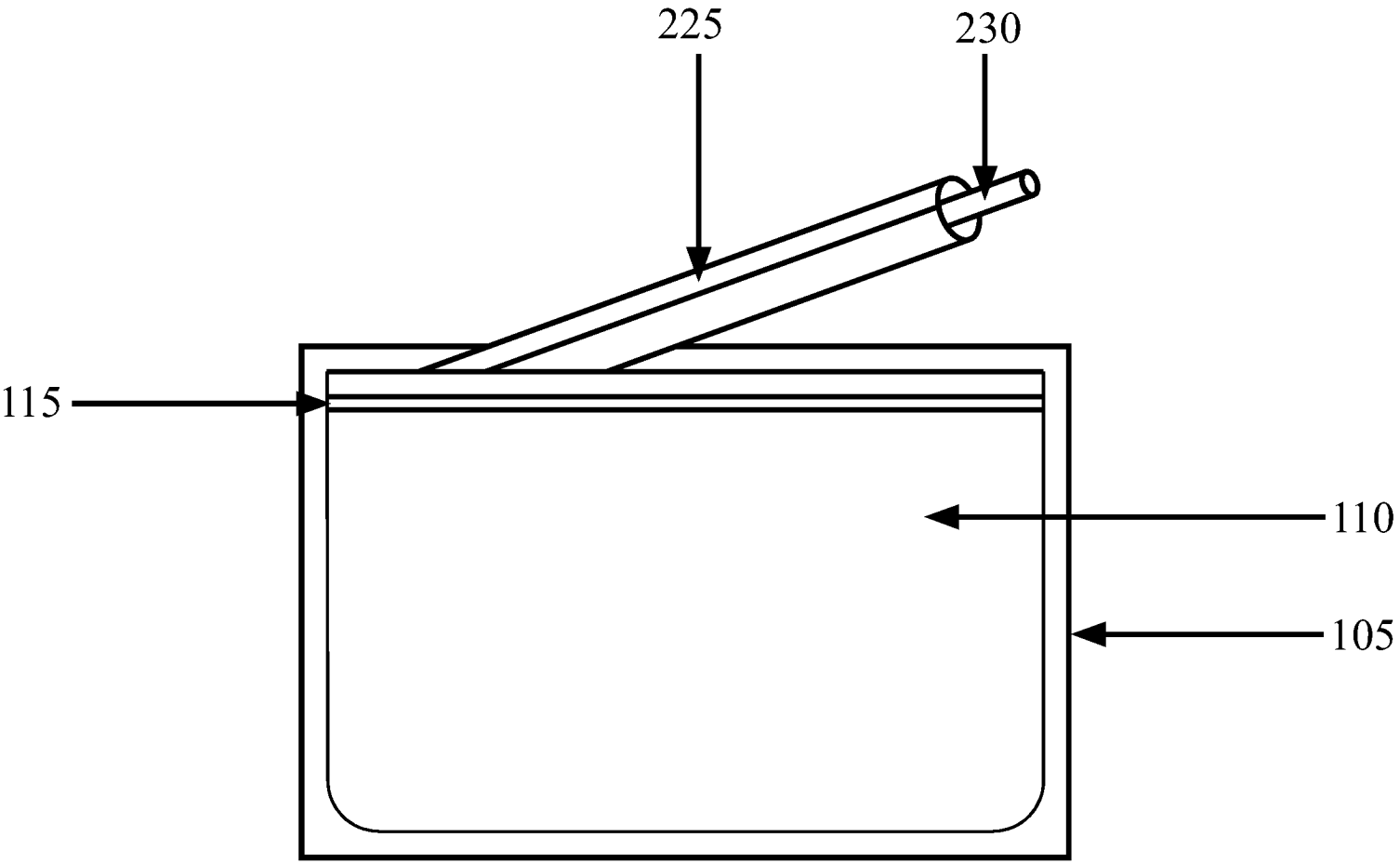
FIG. 2A is a schematic diagram of a re-sealable pouch adapted to contain a rolled cigar tobacco leaf in a transport form, according to an embodiment of the invention.
Figure 2B:
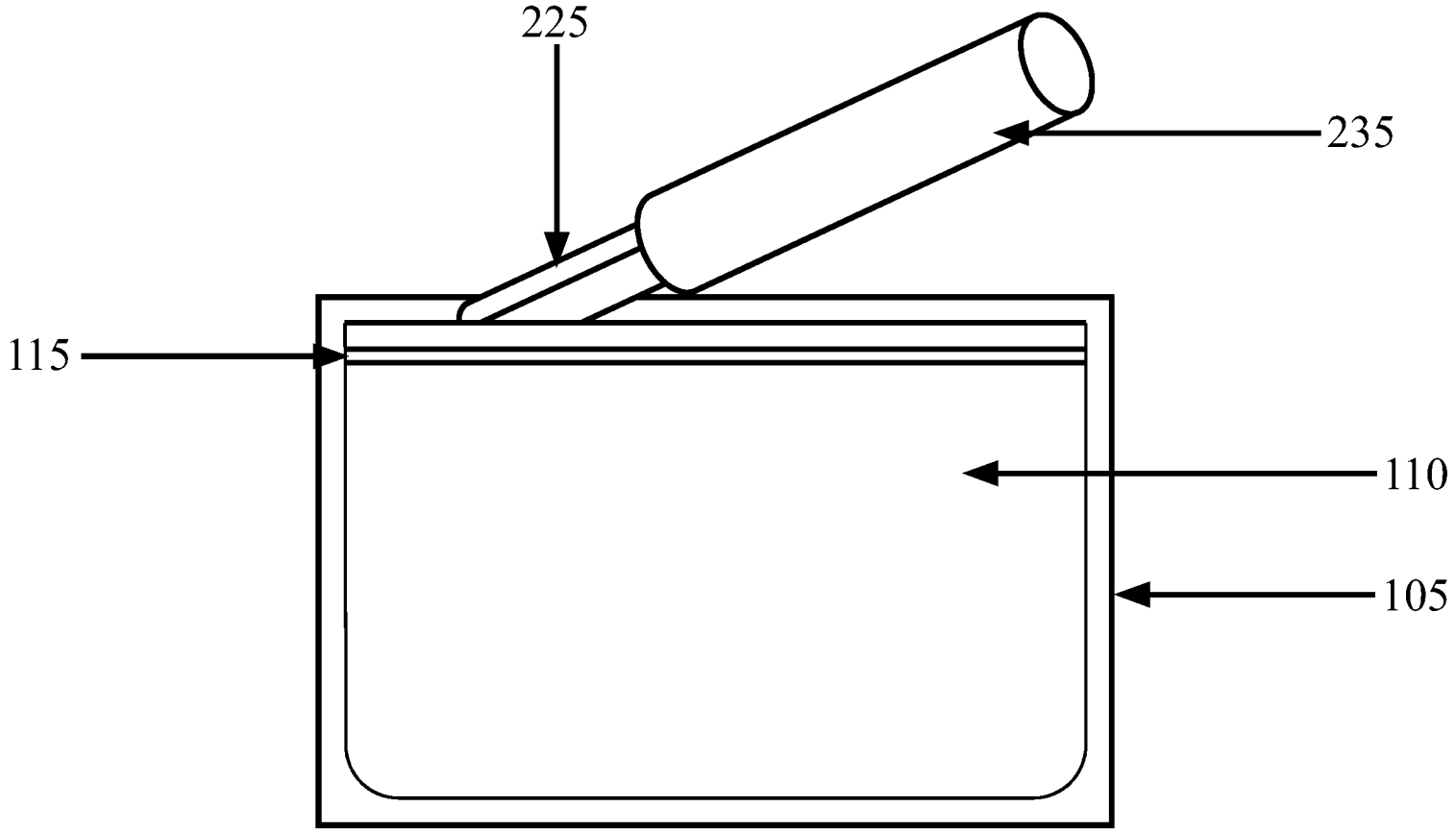
FIG. 2B is a schematic diagram of a re-sealable pouch adapted to contain a rolled cigar tobacco leaf encased in a mold, according to an embodiment of the invention.
Figure 2C:
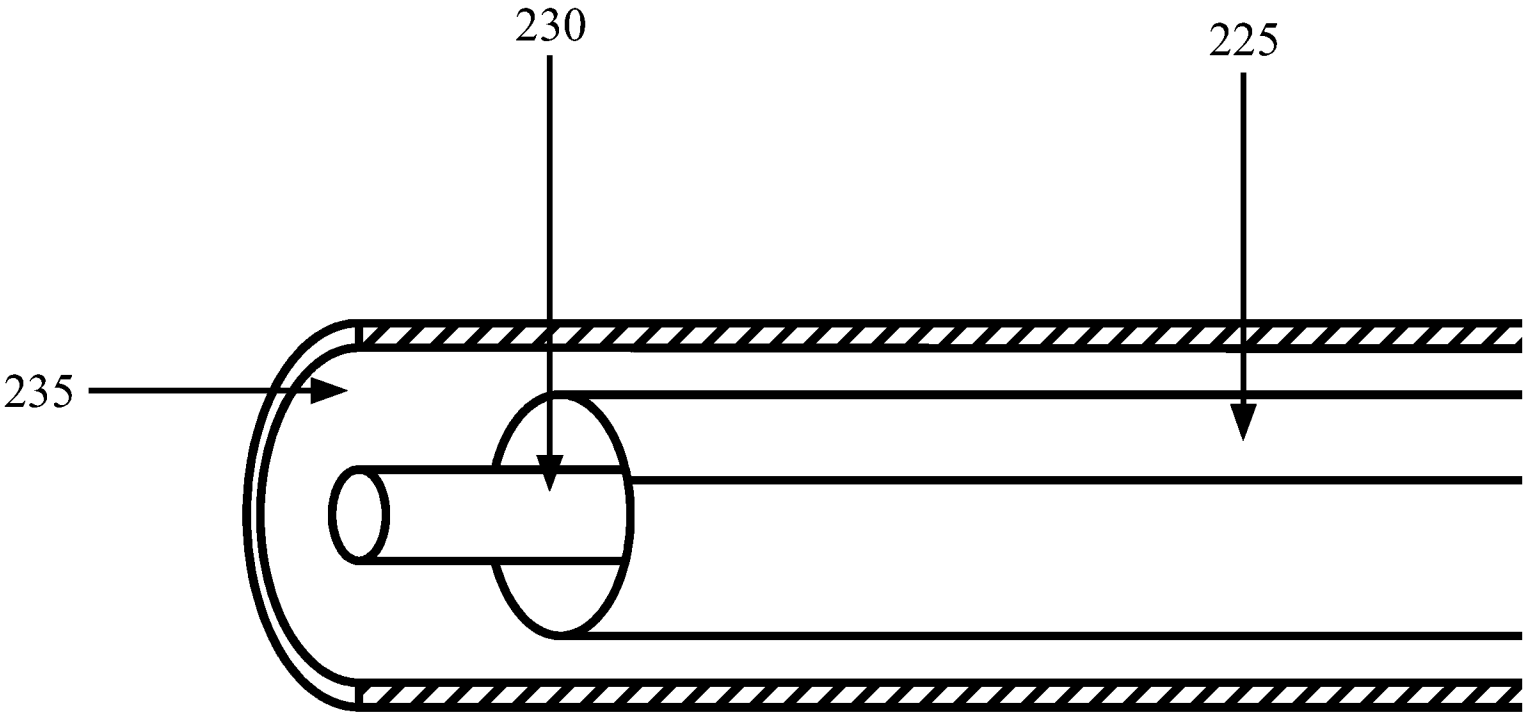
FIG. 2C is a line drawing of a side view of a form and mold, according to an embodiment of the invention.

Once cured and fermented, a cigar tobacco leaf can be inserted into a form and heat and/or pressure applied to induce the cigar tobacco leaf to assume the rolled (or other) shape. The shaped cigar tobacco leaf can also be treated with an additive to inhibit rot. In an embodiment of the invention, an additive can be applied to the cigar tobacco leaf to treat protect the cigar tobacco leaf from leaf rot. Further, a cigar tobacco leaf can be fitted with a transport form to insure that the shape of the cigar tobacco leaf is retained. FIG. 2A is a schematic diagram of a single pouch 105 with a re-sealable opening 115 which allows a rolled cigar tobacco leaf 225 wrapped around a transport form 230 to be contained inside the pouch 110 and packaged. In addition, a cigar tobacco leaf can be fitted with a transport mold to encase the cigar tobacco leaf and otherwise insure that the shape of the cigar tobacco leaf is not damaged from objects pressing on the pouch in transport. FIG. 2B is a schematic diagram of a single pouch 105 with a re-sealable opening 115 which allows a rolled cigar tobacco leaf 225 inserted in a mold 235 to be contained inside the pouch 110 and packaged. In an embodiment of the invention, a mold/form can be used to both insure that the rolled shape is retained and protected from damage during shipping. FIG. 2C is a line drawing of a side view of a form/mold where the rolled cigar tobacco leaf 225 is wrapped around a transport form 230 inside a mold 235.

Figure 3:
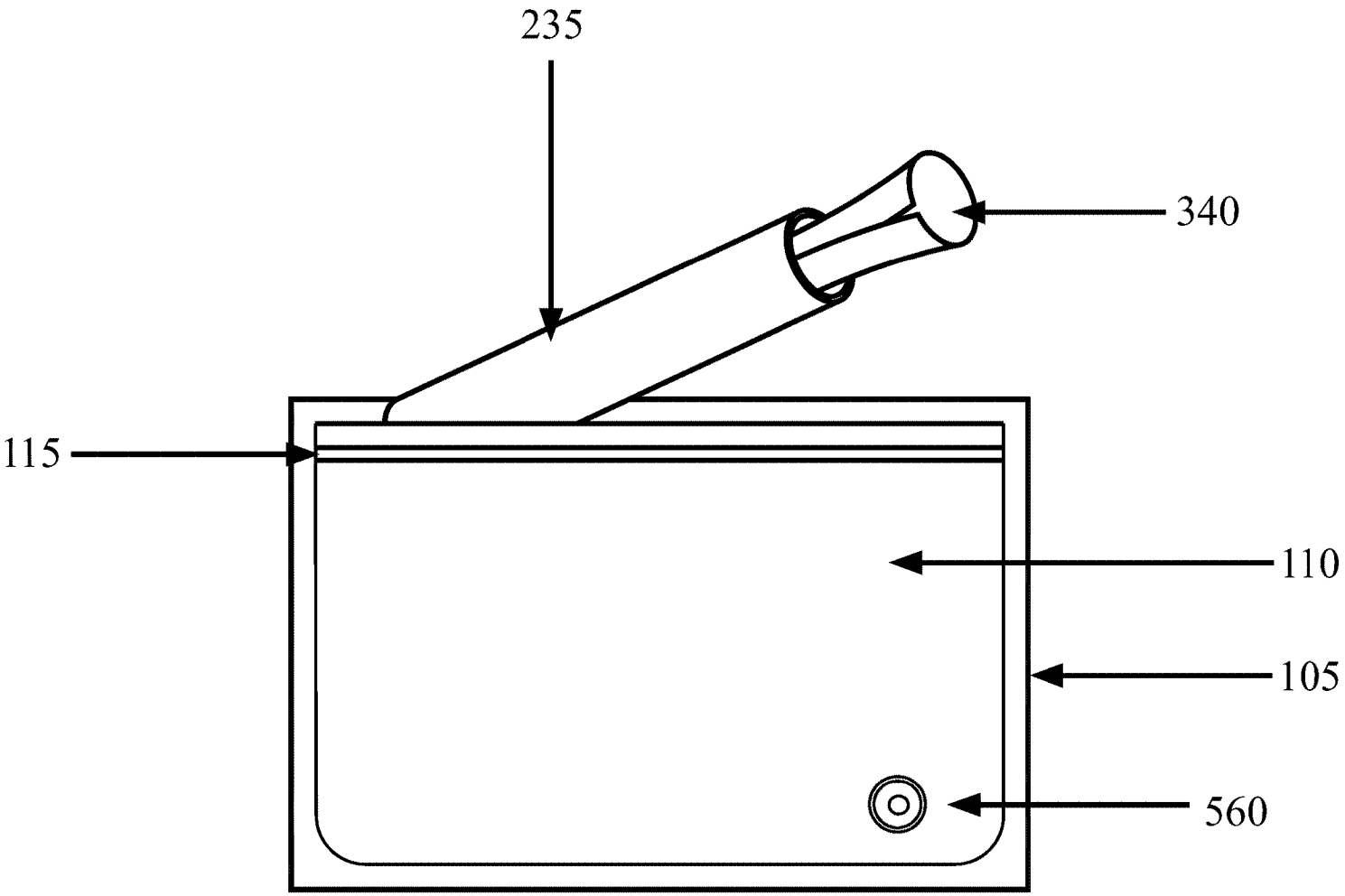
FIG. 3 is a schematic diagram of a re-sealable pouch which allows a cigar tobacco leaf cone to be self-contained, where each cigar leaf cone is inserted in a transport mold, according to an embodiment of the invention.

FIG. 3 is a schematic diagram of a single pouch 105 with a re-sealable opening 115 which allows a cigar tobacco leaf cone 340 inside a mold 235 to be contained inside the pouch 110, where the pouch 110 has a vent/seal 560 to adjust the volume of atmosphere in the pouch 110, to insure that the packaged cigar tobacco leaf cone 340 is protected in the package. The vent/seal 560 is adapted to release atmosphere in the pouch 110 based on the pressure applied to the pouch 110. For a specific user, the pressure can be regulated to allow the volume of atmosphere to be adjusted for that user and the user's specific location, e.g., temperature and humidity of the atmosphere inserted in to the pouch 110. For example a user who has the ability to fill the pouch 110 with an inert gas can choose to keep the pouch 110 fully inflated and thereby protect the pouch from damage by a force impacting the outside of the pouch 110, whereas a user who is residing in a hot humid location with no ability to fill the pouch 110 with anything but the outside air can choose to expel much of the air, thereby reducing the amount of water from the atmosphere in the pouch 110 that a humectant is required to absorb. The user in the hot atmosphere with a deflated pouch 110, can choose to use a mold to protect the contents from a force exerted on the pouch 110. In this manner, a pouch can preserve the contents in two ways (either inflated to protect against e.g., impact, or adjusted deflated to protect against e.g., rot). The user can control the amount of atmosphere expelled based on the force applied to the pouch 110 to expel atmosphere.

Figure 5:
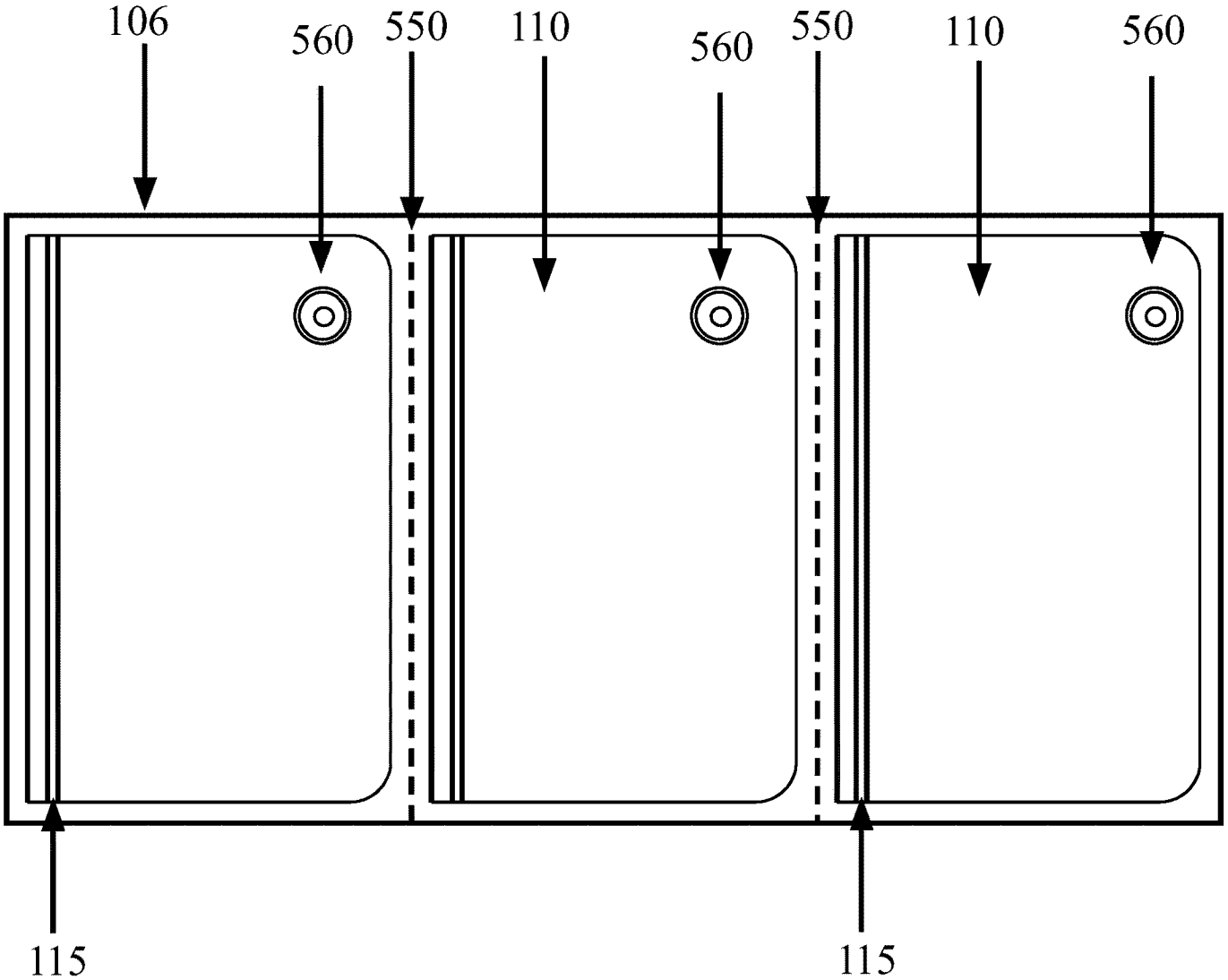
FIG. 5 is a schematic diagram of a pouch pack where each pouch is re-sealable and each pouch can be separated by tearing along the perforation, according to an embodiment of the invention.
Figure 6:
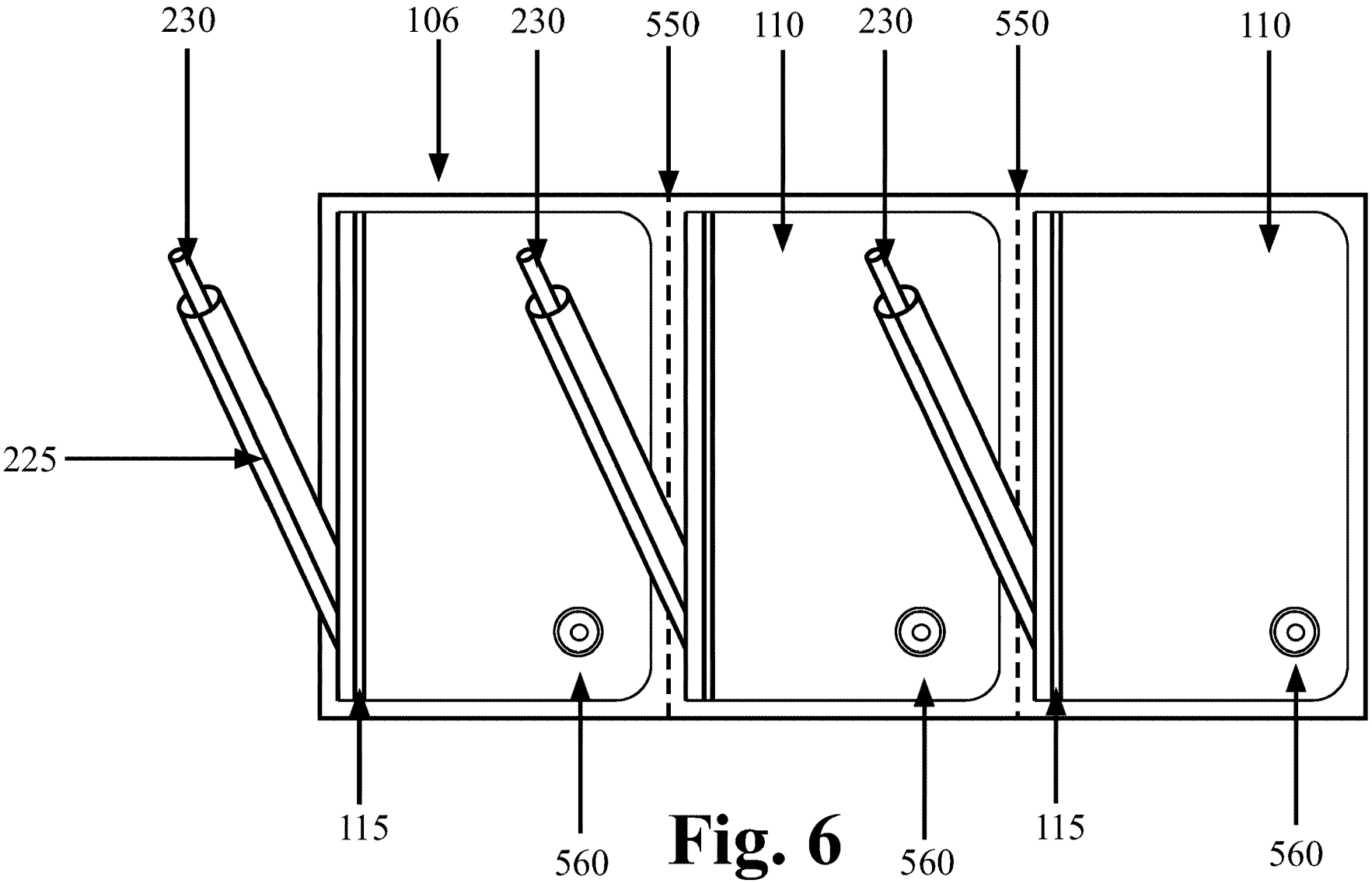
FIG. 6 is a schematic diagram of a pouch pack where each pouch is re-sealable which allows a plurality of rolled cigar tobacco leaves to each be self-contained in a pouch, where a transport form is used to assist in keeping each of the cigar leaves rolled, and each pouch can be separated by tearing along the perforation, according to an embodiment of the invention.

FIG. 5 shows a schematic diagram of a pouch pack 106 where each pouch 110 has a re-sealable airtight opening 115 for transporting cigar tobacco leaves and/or cigars and/or cigar tobacco leaf wrapped mixed plant material, where the pouch 110 has a vent/seal 560 to adjust the volume of atmosphere in the pouch 110, to insure that the contents of the pouch 110 are protected, where the pouch pack 106 can be separated along perforations 550 to release the separate pouches 110. In an embodiment of the present invention, a plurality of separate cigar tobacco leaves are contained in the pouch pack, where each self-contained pouch is re-sealable and each self-contained pouch can be separated from the adjacent self-contained pouch using a perforation to assist tearing. In an embodiment of the present invention, a plurality of separate cigar tobacco leaves in a pouch pack can be sold and distributed as a plurality and each individual pouch can be sold or consumed separately. FIG. 6 is a schematic diagram of a pouch pack 106 where each pouch 110 is re-sealable 115 with a plurality of rolled cigar tobacco leaves 225 wrapped around a transport form 225 each in their separate pouch 110, where the pouch 110 has a vent/seal 560 to adjust the volume of atmosphere in the pouch 110, to insure that the packaged rolled cigar tobacco leaves 225 are protected, where the pouch pack 106 can be separated along perforations 550 to release the separate pouches 110. In an embodiment of the present invention, a single cigar tobacco leaf can be packaged in each pouch. In an alternative embodiment of the present invention, a plurality of cigar tobacco leaves can be packaged in each pouch. In an embodiment of the present invention, the single cigar tobacco leaf packaged in each pouch can be packaged with a humectant. In this manner, the cigar tobacco leaf can be protected in the sealed environment of the pouch. In an embodiment of the present invention, the area of the humectant is sized and cut to mirror the area dimensions of the cigar tobacco leaf. In this manner, the cigar tobacco leaf can be further protected in the sealed environment of the pouch. In an embodiment of the present invention, the shape of the humectant is sized and cut to mirror the shape of the cigar tobacco leaf. In this manner, the cigar tobacco leaf edges can be additionally protected in the sealed environment of the pouch. In an embodiment of the present invention, the thickness of the humectant is approximately the same as the thickness of the cigar tobacco leaf. In this manner, the humectant does not add significantly to the volume of the sealed pouch.

In an embodiment of the present invention, a single 'wrapper' cigar tobacco leaf is tightly rolled into a cylinder shape and inserted into a pouch. In an alternative embodiment of the present invention, a first single 'wrapper' cigar tobacco leaf is tightly rolled into a cylinder shape and a second single 'wrapper' cigar tobacco leaf is tightly wrapped around the first single cigar tobacco leaf to form a fatter cylinder shape and inserted into a pouch. In another alternative embodiment of the present invention, a first single 'wrapper' cigar tobacco leaf is tightly rolled into a cylinder shape and used as a form to protect a second single 'wrapper' cigar tobacco leaf which is loosely wrapped around the form and inserted into a pouch.

While the systems, methods, and devices have been illustrated by describing examples, it is not the intention of the applicants to restrict or in any way limit the scope of the appended claims to such detail. It is, of course, not possible to describe every conceivable combination of components or methodologies for purposes of describing the systems, methods, and devices provided herein. Additional advantages and modifications will readily be apparent to those skilled in the art. Therefore, the invention, in its broader aspects, is not limited to the specific details, the representative system and method or device shown and described. Accordingly, departures may be made from such details without departing from the spirit or scope of the applicant's general inventive concept. Thus, this application is intended to embrace alterations, modifications, and variations that fall within the scope of the appended claims. Furthermore, the preceding description is not meant to limit the scope of the invention. Rather, the scope of the invention is to be determined by the appended claims and their equivalents.

What is claimed is:

1. A system comprising:

a flexible pouch with a gas-tight re-sealable opening;

a cigar tobacco leaf within the flexible pouch;

a form, where the cigar tobacco leaf is at least partially supported by the form; and a mold, where the cigar tobacco leaf is at least partially surrounded by the mold, where the mold is made at least partially from a porous material.

2. The system of claim 1, where the form is made from a tightly wrapped cigar tobacco leaf in a cylinder shape.

3. The system of claim 1, further comprising a valve adapted to control an atmosphere in the flexible pouch.

4. The system of claim 3, where the atmosphere is selected from the group consisting of nitrogen, helium, neon, argon, krypton and xenon.

5. The system of claim 1, further comprising a humectant associated with one or both the mold and the form, where the humectant protects the cigar tobacco leaf from one or more maladies selected from the group consisting of rot, fungal infection, and bacterial infection.

6. The system of claim 1, where the mold is made at least in part of expanded polystyrene.

7. The system of claim 1, where the form is made at least partially from a non-porous material.

8. The system of claim 1, where the mold comprises a material selected from the group consisting of metal, plastic, plastic foam, wood, paper, cardboard, recycled paper, paper amended with recycled paper, cardboard amended with recycled cardboard, and recycled cardboard.

9. A pouch pack comprising:

two or more flexible pouches, where one or more of the two or more flexible pouches comprise a gas-tight re-sealable opening;

a cigar tobacco leaf within one or more of the two or more flexible pouches;

a form within one or more each of the two or more flexible pouches; and a mold within one or more each of the two or more flexible pouches, where the mold is made at least partially from a porous material.

10. The pouch pack of claim 9, where the form is made from a tightly wrapped cigar tobacco leaf in a cylinder shape.

11. The pouch pack of claim 9, further comprising a humectant is associated with one or both the mold and the form, where the humectant protects the cigar tobacco leaf from one or more maladies selected from the group consisting of rot, fungal infection, and bacterial infection.

12. The pouch pack of claim 9, where the form is made at least partially from a non-porous material.

13. The pouch pack of claim 9, further comprising a perforation located in a region connectively joining a first pouch of the two or more flexible pouches to a second pouch of the two or more flexible pouches, where the perforation is adapted to separate the first pouch from the second pouch.

14. The pouch pack of claim 9, where the form supports a cigar tobacco leaf shape and the mold protects the cigar tobacco leaf from an external force.

15. The pouch pack of claim 9, further comprising a valve adapted to control an atmosphere in the pouch pack, where the atmosphere is selected from the group consisting of nitrogen, helium, neon, argon, krypton and xenon.

16. The pouch pack of claim 9, where the mold comprises a material selected from the group consisting of metal, plastic, plastic foam, wood, paper, cardboard, recycled paper, paper amended with recycled paper, cardboard amended with recycled cardboard, and recycled cardboard.

17. A method of using a pouch comprising:

wrapping one or more cigar tobacco leaves to generate a form;

receiving a flexible pouch with a gas-tight re-sealable opening and a valve adapted to regulate an atmosphere in the flexible pouch when the gas-tight re-sealable opening is sealed;

opening the gas-tight re-sealable opening;

wrapping a cigar tobacco leaf around the form;

inserting the cigar tobacco leaf in the form through the gas-tight re-sealable opening into the flexible pouch; and sealing the gas-tight re-sealable opening.

18. The method of claim 17, further comprising delivering an inert gas to the flexible pouch prior to sealing the gas-tight re-sealable opening to regulate the atmosphere in the flexible pouch.

19. The method of claim 18, further comprising encasing the cigar tobacco leaf in a mold.

20. The method of claim 19, where one or both the form and the mold contain a humectant which protects one or both the cigar tobacco leaf and the form in a regulated atmosphere from one or more maladies selected from the group consisting of rot, fungal infection, bacterial infection, fungal degradation, bacterial degradation, microbial degradation and biochemical degradation.

* * * * *